US006540602B2

(12) United States Patent
Adams et al.

(10) Patent No.: US 6,540,602 B2
(45) Date of Patent: Apr. 1, 2003

(54) COIN DISPENSER

(75) Inventors: Thomas P. Adams, Oconomowoc, WI (US); Robert Zwieg, Watertown, WI (US); Joseph Hanus, Watertown, WI (US)

(73) Assignee: De La Rue Cash Systems, Inc., Lisle, IL (US)

( * ) Notice: Subject to any disclaimer, the term of this patent is extended or adjusted under 35 U.S.C. 154(b) by 0 days.

(21) Appl. No.: 09/785,229

(22) Filed: Feb. 20, 2001

(65) Prior Publication Data

US 2002/0115403 A1 Aug. 22, 2002

(51) Int. Cl.[7] ..... G07D 1/00; G07D 1/02

(52) U.S. Cl. ..... 453/40; 453/49

(58) Field of Search ..... 453/1, 2, 21, 24, 453/25, 29, 37, 40, 41, 43, 49, 53, 54, 57

(56) References Cited

U.S. PATENT DOCUMENTS

| | | | |
|---|---|---|---|
| 3,034,517 | A | 5/1962 | Reiland |
| 3,191,609 | A | 6/1965 | Gauselmann et al. |
| 3,590,833 | A | 7/1971 | Walton |
| 3,650,085 | A | 3/1972 | Bay |
| 3,941,138 | A | 3/1976 | Woodhouse |
| 4,221,227 | A | 9/1980 | Heiman |
| 4,276,894 | A | 7/1981 | Heywood |
| 4,495,959 | A | 1/1985 | Farber |
| 4,593,709 | A | 6/1986 | Duplessy |
| 4,943,257 | A | 7/1990 | Nilsson et al. |
| 5,066,262 | A | 11/1991 | Abe |
| 5,122,094 | A | 6/1992 | Abe |
| 5,492,212 | A | 2/1996 | Fillod et al. |
| 5,944,601 | A | 8/1999 | Hayashi et al. |

*Primary Examiner*—Donald P. Walsh
*Assistant Examiner*—Mark Beauchaine
(74) *Attorney, Agent, or Firm*—Oliff & Berridge, PLC

(57) ABSTRACT

A coin dispenser includes a rotatable magazine and a stationary actuator. The rotatable magazine rotates about a rotation axis and includes a plurality of coin receptacles extending substantially parallel to the rotation axis. Each coin receptacle holds a stack of coins therein. The stationary actuator includes a coin-ejection member that moves linearly in a direction substantially parallel to the rotation axis of the rotatable magazine. When in an extended position, the coin-ejection member will contact an edge of at least a lowermost coin in a specified one of the coin receptacles as the magazine rotates to move that coin receptacle into alignment with the coin-ejection member, thereby ejecting that coin from the coin dispenser. When the coin-ejection member is in its retracted position, the coin receptacles will travel past the coin ejection member without any engagement occurring between the coin-ejection member and the coins within the receptacles.

22 Claims, 6 Drawing Sheets

COIN DISPENSER

BACKGROUND OF THE INVENTION

1. Field of Invention

The invention relates to coin dispensers, and in particular to automatic coin dispensers for selectively dispensing coins in order to make change. Such coin dispensers are often found, for example, at checkout counters of grocery stores and at the cashier of restaurants, convenience stores, etc., although they have numerous other applications.

2. Description of Related Art

The most common type of coin dispenser for use, for example, in grocery stores or in other applications in combination with a checkout counter or cashier, has a series of vertically extending coin holding tubes that are arranged in a line. Examples of such coin dispensers are shown, for example, in U.S. Pat. Nos. 3,590,833 and 4,593,709.

While being popular and reliable, these coin dispensers are mechanically complicated and, therefore, are expensive due to the large number of parts and the large amount of time required to manufacture such dispensers. This is because a separate actuator (e.g., a solenoid) must be provided for each coin-holding tube. Thus, a coin dispenser having nine coin tubes requires at least nine separate actuators.

Additionally, because the plurality of coin tubes are arranged in a line and are stationary, an inclined ramp must be provided below the line of coin-holding tubes so that the coins ejected from the various tubes will be conveyed, by gravity, to a coin-receiving cup. The requirement for this inclined ramp increases the height of the dispenser, further increasing its size and weight.

U.S. Pat. Nos. 3,191,609 and 4,276,894 disclose arrangements in which a single actuator is used to selectively eject coins from a plurality of coin tubes.

The arrangement disclosed in U.S. Pat. No. 3,191,609 includes a stationary housing in which a plurality of vertical tube-like coin containers are arranged in a circle or oval. A central rotary part includes a single actuator having a carrier pin that is selectively extended and retracted. As the rotary part rotates beneath each of the coin containers, the actuator is selectively energized in order to dispense coins from the containers. The rotary part also includes a coin collecting tray into which the coins that are to be dispensed fall. The actuator is movably mounted, and biased into its normal position by a torsion spring, so that the actuator can move out of its normal position without being damaged in the event that there is a jam condition. Because the coin collecting tray rotates with the rotary part, the rotary part must come to a complete stop at a particular position relative to the housing so that the coins located in the coin collecting tray can be accessed through an opening in the housing. This increases the amount of time required to complete a coin dispensing cycle because the rotary part must be brought to a complete stop at a predetermined position before the coins are dispensed.

The arrangement disclosed in U.S. Pat. No. 4,276,894 mounts a plurality of vertical coin tubes, arranged in a circle, on a rotatable base. As the base rotates, the coin tubes selectively become aligned with a coin ejecting mechanism which can be activated in order to eject a coin from that tube. The coin ejecting mechanism includes a pin that moves radially outward with respect to the rotatable base in order to eject a coin from a selected coin tube. This arrangement requires precise timing between the rotation of the rotatable base and the radial movement of the pin, and therefore includes a complicated gear arrangement.

Accordingly, there is a need for an improved coin dispenser that has a relatively simple construction, and therefore a lower manufacturing cost, and that also is relatively compact in size.

SUMMARY OF THE INVENTION

According to one aspect of the invention, a coin dispenser includes a rotatable magazine and a stationary actuator that is operative to eject coins from the rotatable magazine. The magazine rotates about a rotation axis and includes a plurality of coin receptacles extending substantially parallel to the rotation axis. Each coin receptacle holds a stack of coins. The stationary actuator includes a coin-ejection member that moves linearly in a direction substantially parallel to the rotation axis of the rotatable magazine between an extended position and a retracted position. When the coin-ejection member is in its extended position, it will engage the outer edge of at least a lowermost coin in a specified one of the coin receptacles as the magazine rotates, and therefore will eject that coin out of the coin dispenser.

A lowermost portion of each coin receptacle includes a coin-ejection slot through which at least a lowermost coin in that receptacle is ejected from the rotatable magazine as the receptacle is conveyed past the coin-ejection member when in the extended position. Preferably, each of the coin-ejection slots includes a longitudinal axis that extends at a non-zero angle relative to a radial direction of the magazine. This reduces the possibility of coins being accidentally ejected from the magazine due to centrifugal forces caused by rotation of the magazine.

Preferably, each of the coin-ejection slots has an outlet on a radially outer surface of the rotatable magazine. It is, of course, possible to provide the outlet on a radially inner surface of the rotatable magazine. However, providing the outlets on the radially outer surface of the magazine enables the overall height of the coin dispenser to be minimized since it would be necessary to provide a ramp in order to direct coins to the outlet of the coin dispenser if the coins were ejected radially inwardly from the magazine.

In a preferred embodiment, the coin dispenser includes a stationary base and a drive motor mounted to the stationary base. The drive motor includes a drive gear that removably couples to and rotates the rotatable magazine about the rotation axis when the magazine is mounted to the stationary base.

In a preferred embodiment, the stationary actuator includes a single electro-mechanical actuator (e.g., a solenoid). More preferably, the drive motor and the single electro-mechanical actuator are the only electro-mechanical drive mechanisms included in the coin dispenser. Accordingly, the coin dispenser requires only two electro-mechanical drive mechanisms, thereby reducing its costs.

Preferably, the stationary actuator includes a torsion-resistant mount that permits the coin-ejection member to deflect if a coin that is to be ejected from the magazine becomes jammed in the magazine. This functions as a fail-safe mechanism, and prevents the coin ejection mechanism from being damaged.

Preferably, a single low-coin detector, such as, e.g., a photo-detector or a proximity sensor, is provided to detect whether the supply of coins in any of the receptacles is low. The machine can then avoid selecting receptacles having a low supply (for example, if one quarter receptacle is low, a different quarter receptacle is selected, or two dime receptacles and one nickel receptacle are selected), and/or provide an audible or visual alarm indicating that the magazine should be replaced.

According to one embodiment, the floor plate of the magazine includes a recess for each receptacle, onto which the lowermost coin in each receptacle rests. Preferably, the depth of each recess is determined based upon the thickness of the type of coin to be dispensed from that receptacle so that the upper surface of the lowermost coin in all receptacles are located in a common plane. The coin-ejection member includes an upper shoulder and a pin that extends upwardly from the shoulder. The floor plate includes a groove through which the pin extends when in its extended position, and a lower planar surface that is engaged by the shoulder when the coin-ejection member is extended. This arrangement results in the uppermost portion of the pin being maintained a predetermined distance below the coin that rests on top of the lowermost coin in each receptacle, so that only the lowermost coin is ejected. In addition, by selecting an appropriate depth of a recess, the pin can be made to contact the two lowest coins in a receptacle so that two coins can be ejected simultaneously from one receptacle.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

The coin dispenser of the invention can be used in many applications. For example, the coin dispenser can be used to dispense change at the checkout counter of a grocery store or a convenience store, or at the cashier of a restaurant. The coin dispenser can be provided as part of a system that provides change in exchange for paper currency, or it can be provided in tandem with a currency dispenser, for example, as part of an ATM. It also could be part of a point-of-sale terminal.

The dispenser can be used with a variety of different magazines containing different mixes of coins. For example, one magazine could have coin receptacles with different sizes (diameters) to hold a mix of coins (pennies, nickels, dimes, quarters, dollar coins), while another magazine could have coin receptacles with equal sizes (e.g., all holding quarters or tokens, which would be useful at an arcade).

Figure 1:
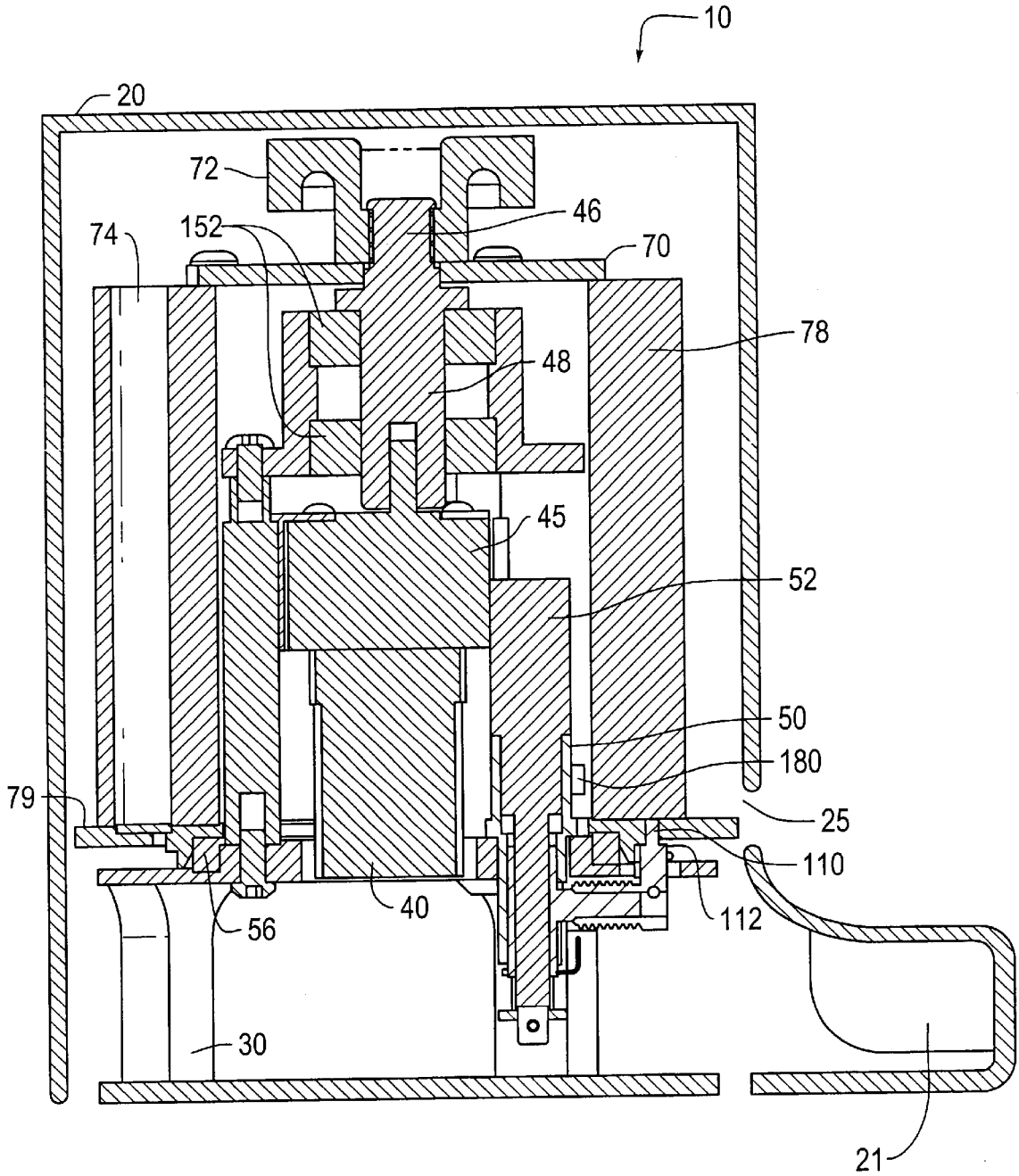
FIG. 1 is a side cross-sectional view of a coin dispenser according to one embodiment of the invention.

A coin dispenser according to one embodiment of the invention will now be described in conjunction with FIGS. 1–7. As shown in FIG. 1, a coin dispenser 10 includes an outer, generally cylindrical housing 20, a stationary base 30 on which a motor 40 and an ejector mechanism 50 are mounted, and a rotatable coin holding magazine 70 that is rotated by motor 40. Housing 20 is generally cylindrical in shape, and includes a coin receiving cup 21 that receives coins ejected from the rotatable magazine through an outlet 25 in the housing 20. The housing preferably is formed from a heavy duty material such as, for example, heavy duty plastic, aluminum or stainless steel. In addition, the housing 20 preferably is locked to the stationary base 30 to prevent access thereto by unauthorized personnel. As an alternative, the cup 21 can be provided as a separate piece from the housing 20, or can be mounted to the base 30 separately from the housing 20.

Figure 2:
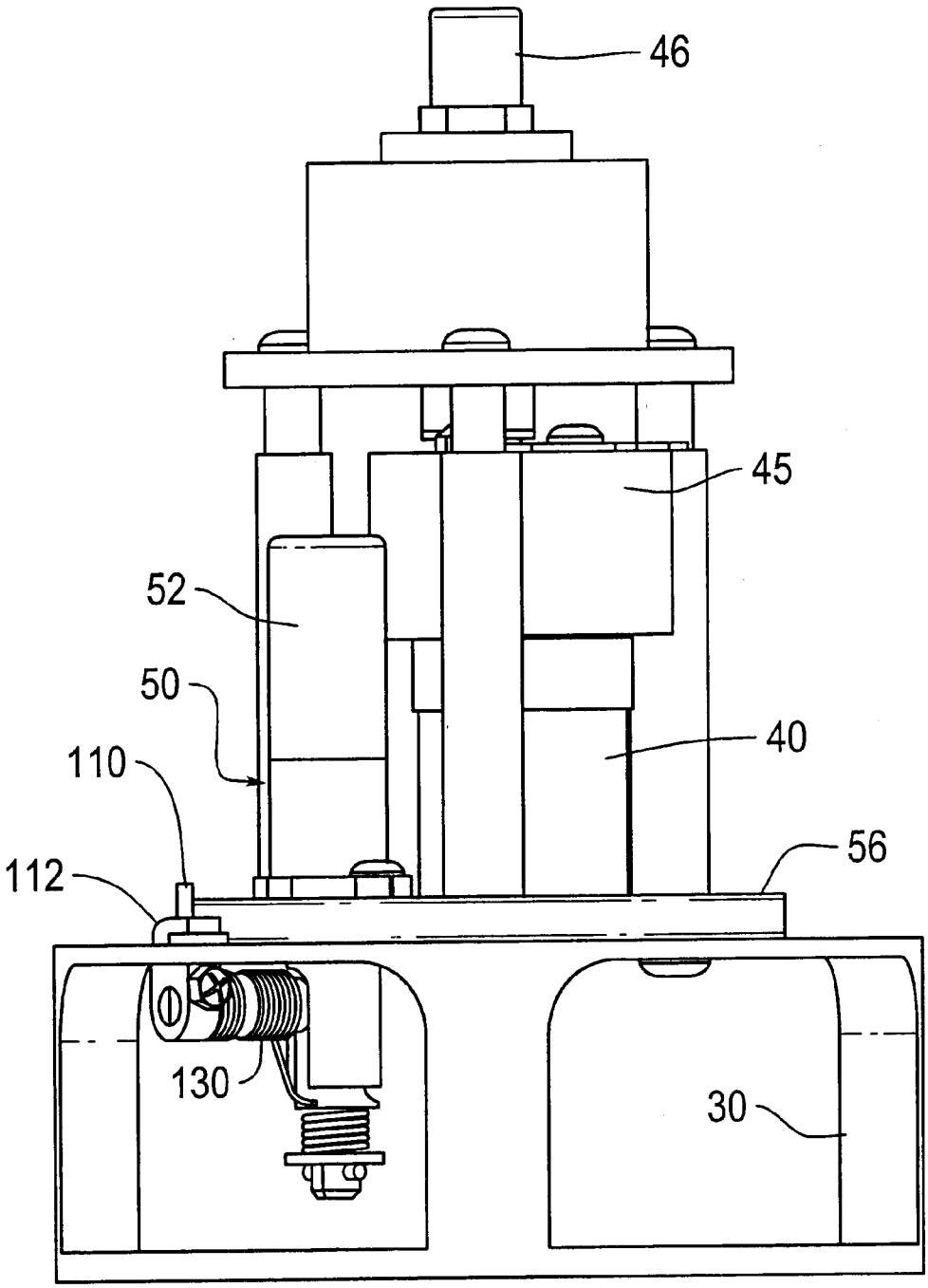
FIG. 2 is a side view of the stationary portion of the coin dispenser of FIG. 1, including the base, the coin ejector structure and the motor for rotating the coin magazine.

Referring to FIGS. 1 and 2, the stationary base 30 is circular in plan view, and has motor 40 mounted thereto. The motor 40 has an output shaft that drives a gear box 45, which in turn drives a drive shaft 48 having a drive gear 46 located at one end (the upper end) thereof. The drive shaft 48 is mounted in bearings 152. The ejector mechanism 50 includes a pull-type solenoid 52 that is fixedly mounted to the base 30. The solenoid 52 is used to move a pin ejector 110 in order to eject coins from the dispenser, as will be described below.

Figure 3:
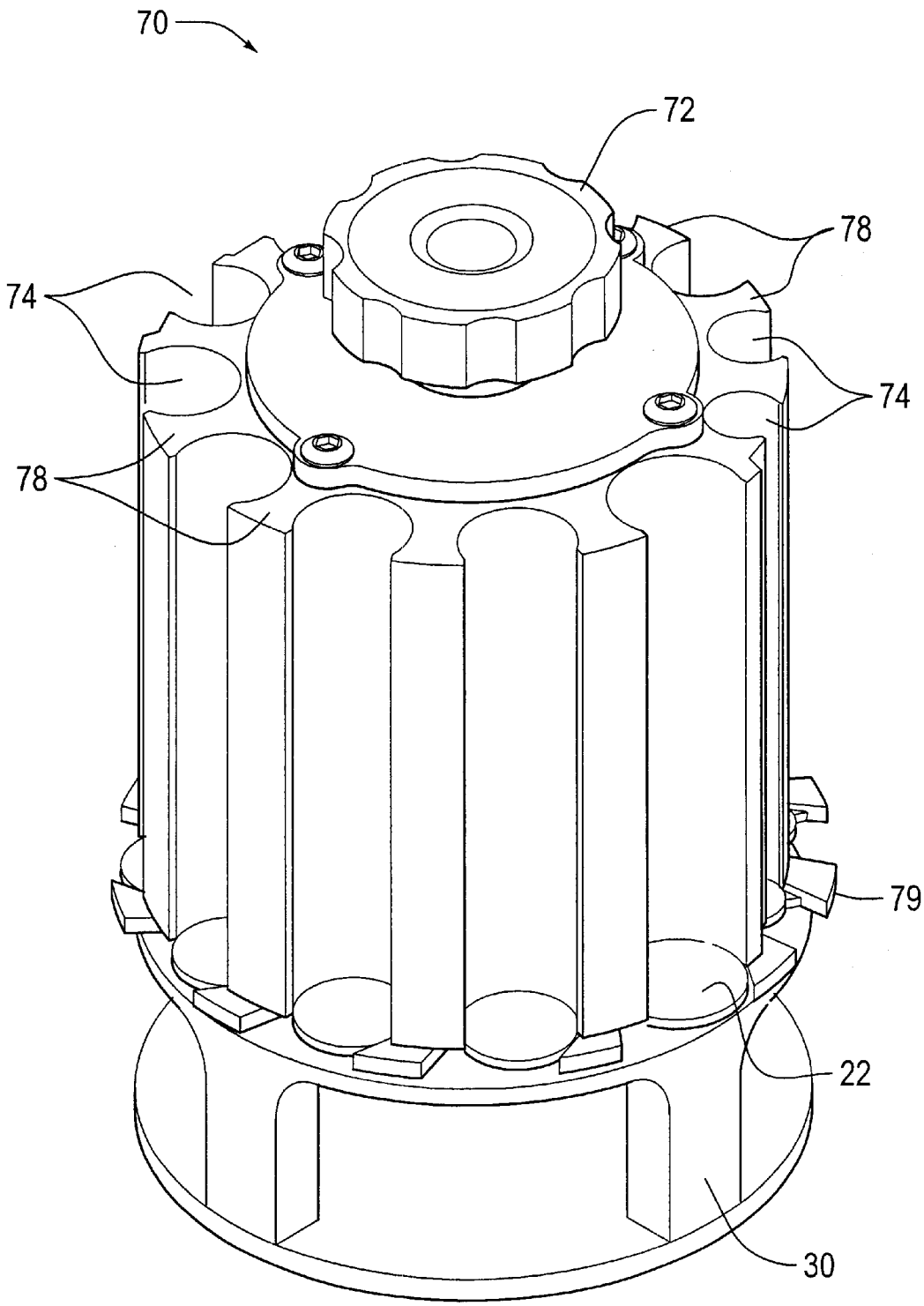
FIG. 3 is a perspective view of the rotatable coin magazine mounted on the stationary base.

As shown in FIGS. 1 and 3, the rotatable coin-holding magazine 70 is generally cylindrical in shape and includes a plurality of longitudinally extending coin-holding receptacles 74 at its circumference, and opening through its outer surface. Each receptacle 74 is separated from an adjacent receptacle by a wall 78. Each receptacle 74 holds a vertically extending stack of coins 22 therein. The top of the magazine 70 includes a knob-like handle 72 by which a person can hold and carry the magazine 70. Within the knob, is provided a female-type driven gear that engages the drive gear 46 on the end of the drive shaft 48. Accordingly, when motor 40 is actuated, the rotatable magazine 70 will rotate about a vertical rotation axis relative to the stationary base 30. As the magazine 70 rotates, the lower portion of each coin-holding receptacle 74 will pass over a coin-ejection pin 110, thereby enabling the ejection pin 110 to eject the lowermost coin in the stack of coins contained in that receptacle 74 if the solenoid 52 is actuated.

As shown in FIGS. 1 and 2, a ring bearing 56 is provided on the stationary base 30 to rotatably support the magazine 70 relative to the base 30.

Figure 4:
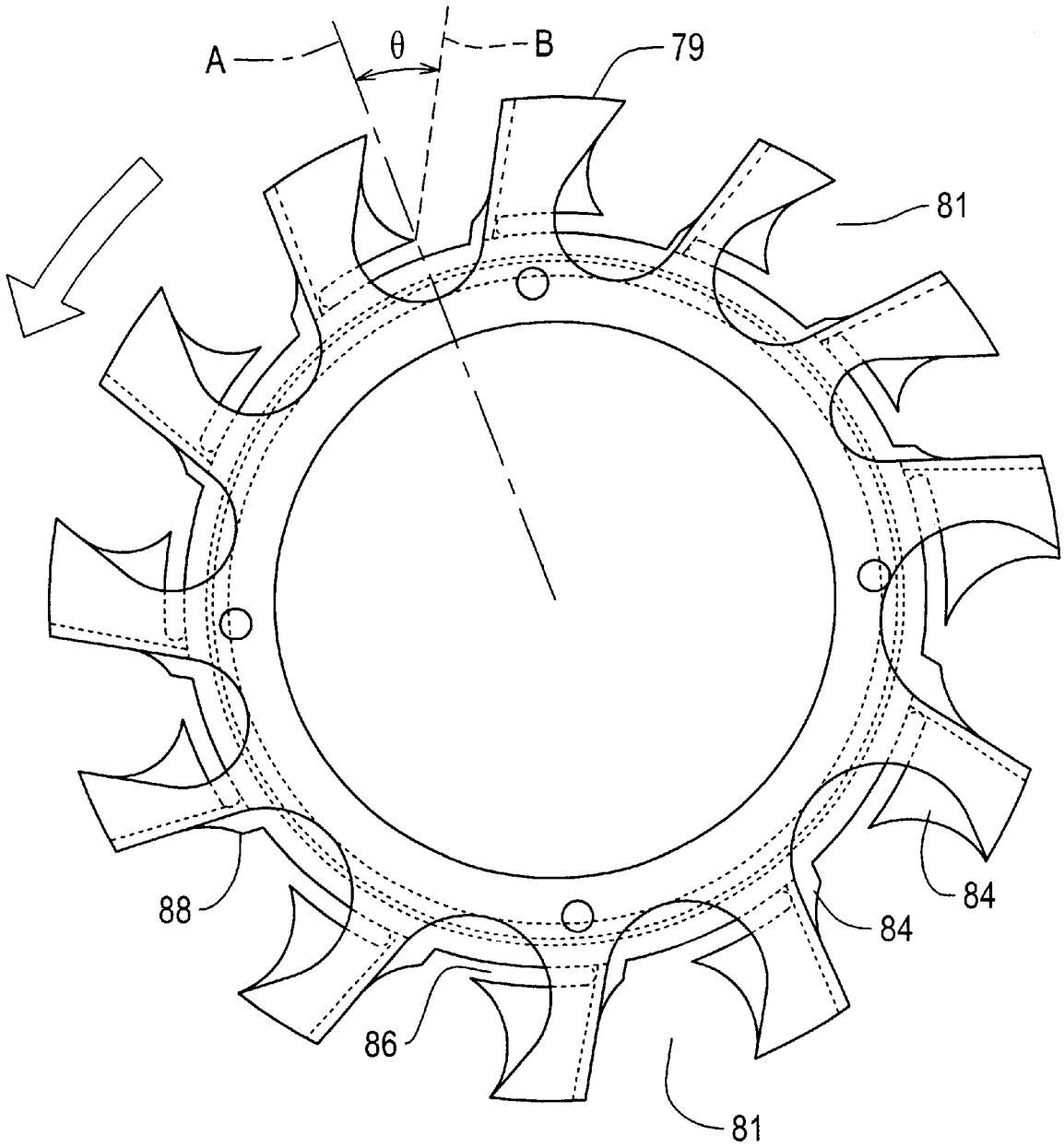
FIG. 4 is a plan view of the floor plate of the rotatable magazine.

The rotatable magazine 70 includes a floor plate 79 as shown in FIGS. 3 and 4. The floor plate 79 is formed by attaching two annular plates to each other so that the floor plate defines a plurality of ejection slots 81, having the structure described below, at the bottom of each coin-holding receptacle 74.

The structure of the floor plate 79 will now be described in conjunction with FIG. 4, which is a plan view of the floor plate 79. As can be appreciated from FIG. 4, each coin-ejection slot 81 is angled (rather than extending radially outward from a center point of the floor plate 79). Referring to FIG. 4, if the line labeled A extends from the center point of floor plate 79 through a center point of the slot 81, and the line labeled B extends through the center point of the slot and is parallel to the side walls of the slot, then the slot (i.e., the longitudinal axis of the slot) extends at angle θ. The direction in which the magazine rotates is illustrated by the arrow in FIG. 4. Angling the ejection slots 81 reduces the likelihood that coins will be ejected inadvertently due to centrifugal force. Angling the ejection slots 81 also assists in ejecting coins at the time of ejection because more force would have to be applied to the coins by the pin 110 if the coins were ejected radially outward along the line labeled A in FIG. 4.

Figure 5:
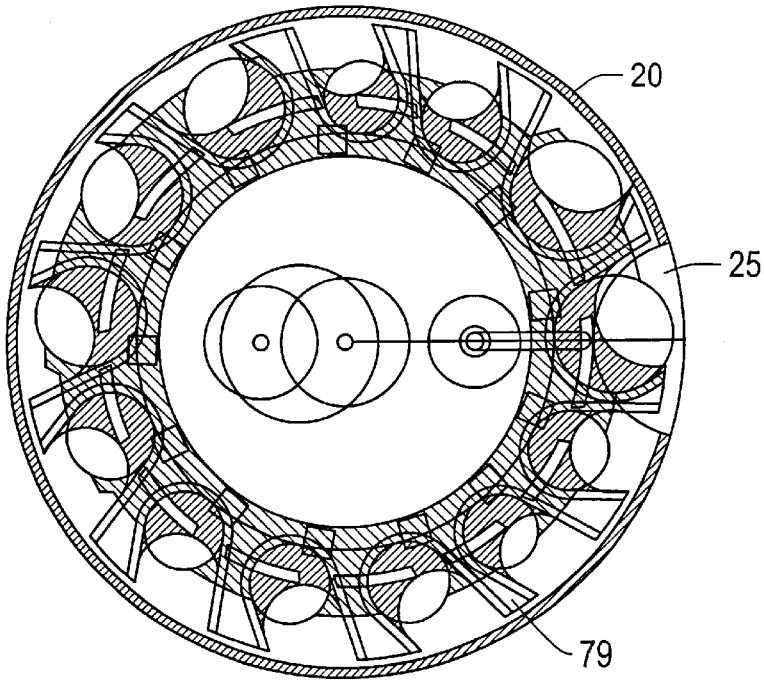
FIG. 5 is a plan view of a floor plate for a magazine having a different number of slots, and illustrating the coins loaded into the magazine.

Each coin-ejection slot 81 includes a floor 84 on which the lowermost coin in each stack will rest. The floor must be large enough to prevent the coins from falling through the slot 81 even when a single coin is located in channel 74. The relationship between the size of the floor 84 and variously sized coins is illustrated in FIG. 5, in which the cross-hatched areas correspond to the floor 84.

An arcuate slot 86 is provided in each coin-ejection slot 81, and is aligned with the coin-ejection pin 110 of the ejection mechanism 50. In addition, the lower surface of the floor 84 provided where the slot 86 ends (this location is identified by reference numeral 88 in FIG. 4) is sloped. The sloped lower surface of this portion of the floor 84 will assist the ejection pin 110 to move vertically downward into its retracted (lower) position after ejecting a coin from a particular coin receptacle 74.

Figure 8:
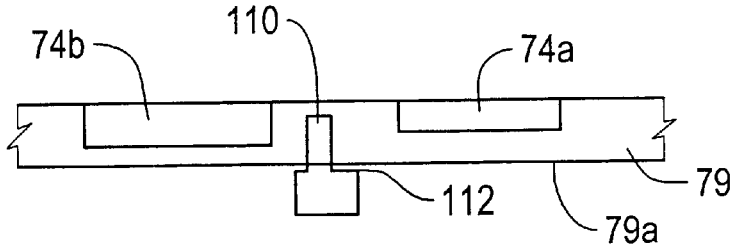
FIG. 8 is a side view showing the coin recesses formed in the floor plate for coins having different thicknesses.

FIG. 8 is a side view of a portion of the floor plate 79, and illustrates a preferred structure of the floor plate 79. The floor plate 79 of the magazine 70 includes a recess for each receptacle. The lowermost coin in each receptacle rests on the bottom of this recess, which forms the floor 84. Preferably, the depth of each recess is determined based upon the thickness of the type of coin to be dispensed from the receptacle associated with that recess. The depth is selected so that the upper surface of the lowermost coin in all receptacles are located in a common plane. In FIG. 8, recess 74*b* is for quarters, whereas recess 74*a* is for dimes. Thus, as can be seen in FIG. 8, recess 74*b* is deeper than recess 74*a* because quarters are thicker than dimes. The coin-ejection member includes an upper shoulder 112 and a pin 110 that extends upwardly from the shoulder 112. The floor plate 79 includes a groove 86 (not shown in FIG. 8) through which the pin extends when in its extended position. The lower surface 79*a* of the floor plate 79 is planar, and is engaged by the shoulder 112 when the coin-ejection member is extended. This arrangement results in the uppermost portion of the pin 10 being maintained a predetermined distance (e.g., 0.015 inches) below the coin that rests on top of the lowermost coin in each receptacle, so that only the lowermost coin is ejected. In addition, by selecting an appropriate depth of a recess, the pin can be made to contact the two lowest coins in a receptacle so that two coins can be ejected simultaneously from one receptacle.

Figure 6:
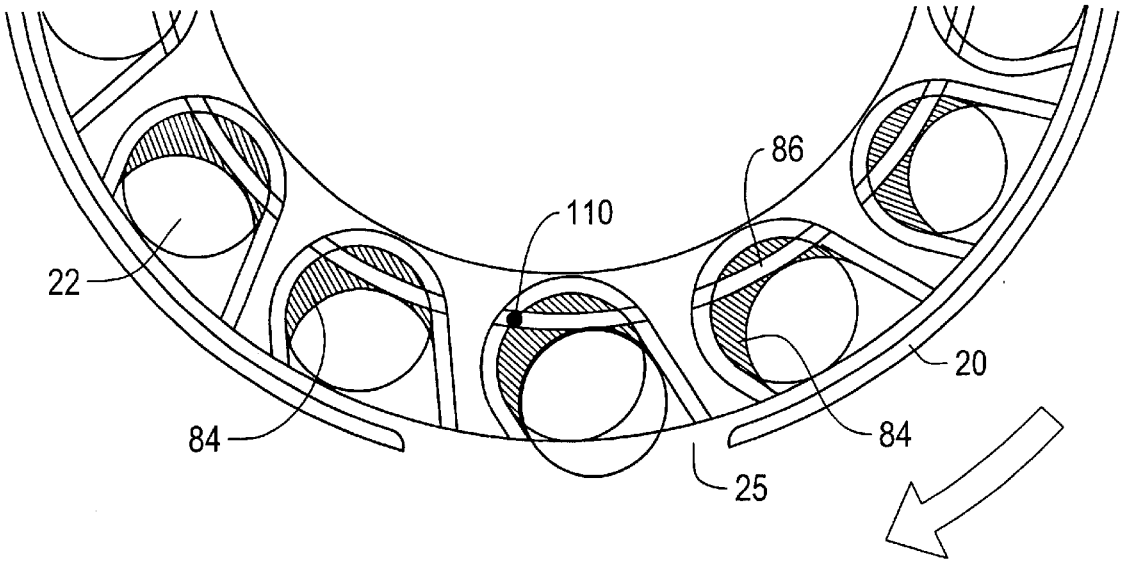
FIG. 6 illustrates the manner in which coins are ejected from the magazine.

The manner in which a coin is ejected from a receptacle 74 is illustrated diagrammatically in FIG. 6. FIG. 6 illustrates the relative position between the rotating magazine 70 and the outer housing 20. The rotation direction of the magazine 70 is illustrated by the arrow in FIG. 6. When a coin receptacle 74 containing a coin that is to be dispensed reaches the outlet 25, the ejection mechanism 50 will, by actuating solenoid 52, cause pin 110 to move vertically upward through slot 86 such that it will contact the side surface of the lowermost coin in that receptacle 74. FIG. 6 illustrates the location of the pin 110 as a particular receptacle 74 starts coming into alignment with that pin 110. The location where the pin engages the coin is determined such that it will engage the coin at a point approximately midway between the opposite side walls of the slot 81. This will "kick" the coin out of the slot, through the outlet 25 and into the cup 21 (not shown in FIG. 6). The solenoid 52 is then deactivated such that the pin 110 moves vertically downward and is retracted from the slot 86. However, even if the pin does not fully retract, when the pin comes into alignment with the inclined portion 88, the inclined portion will gradually urge the pin 110 downward into its retracted position. Accordingly, the pin will not engage the lowermost coin in the next slot 81 when that slot comes into alignment with the pin 110 unless the solenoid 52 is actuated again. Thus, the coin-ejection pin 110 moves linearly in a direction substantially parallel to the (vertical) rotation axis of the magazine 70 between an extended position and a retracted position. Substantially parallel is meant to encompass pins that move in a direction that is slightly different from the magazine rotation axis direction as well as pins that move in exactly the same direction as the rotation axis direction (i.e., there can be some tolerance in the pin movement direction as long as it is primarily parallel to the magazine rotation axis). This can be contrasted with the ejector of U.S. Pat. No. 4,276,894, which moves substantially perpendicular to the rotation axis of the magazine.

Figure 7:
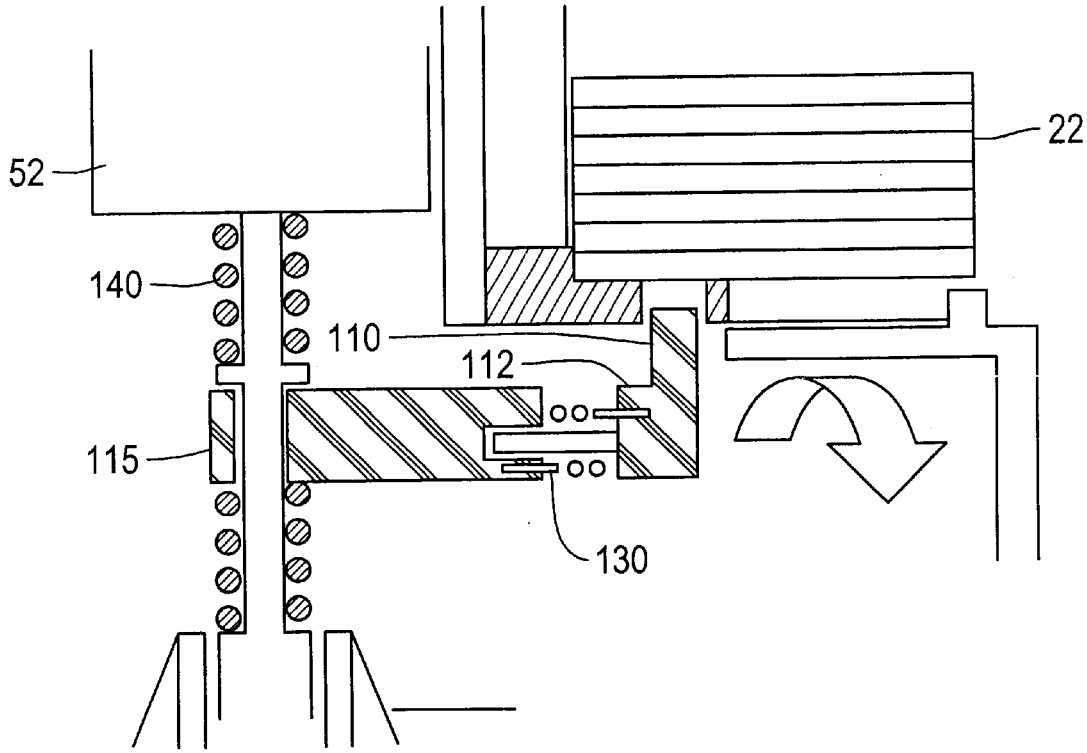
FIG. 7 is a schematic view of the ejector mechanism for the coin dispenser.

Bent coins can become jammed in a slot 81. Jamming of a coin could cause the ejector mechanism 50 to be destroyed since it is basically a flywheel rotating at a relatively high speed (about 30 rpm) and has a high weight (particularly when filled with coins). In order to prevent the ejector mechanism from being destroyed when a jammed coin is encountered, a torsion-resistant mount preferably is provided between the piece containing the ejection pin 110 and the solenoid 52, as shown in FIG. 7. In particular, a torsion spring 130 is mounted between a pin holder 115 and the piece containing the pin 110. The piece containing the pin 110 is rotatably mounted to the pin holder 115 so that it can rotate about a horizontal axis in FIG. 7. The torsion spring 130 biases the piece containing the ejection pin 110 against a stop so that in its normal state, the ejection pin 110 extends vertically upward. However, if a jammed coin is encountered, the torsion spring 130 and the horizontally rotatable connection between the pin holder 115 and the piece containing the pin 110 enables the pin 110 to rotate about a horizontal axis, as illustrated by the arrow in FIG. 7, so that the ejector mechanism 50 will not be destroyed. The ejector mechanism 50 also includes vertically arranged spring 140. Spring 140 biases the pin holder 115 downward. Accordingly, when the solenoid 52, which is a pull-type solenoid, is not actuated, spring 140 causes pin holder 115 to move to its lower position. When the solenoid 52 is actuated, however, it will retract, compressing spring 140, thereby moving the pin holder 115 and the piece containing the shoulder 112 and the ejection pin 110 upward. Preferably, the strength by which the solenoid pulls when activated is about twice the strength of the compression spring 140.

According to one preferred embodiment, the magazine 70 is rotated at 30 RPM. Accordingly, if the mix of coins contained in the magazine is such that one complete rotation can provide up to 99 cents (or $4.99), the machine is capable of outputting a complete set of change once every two seconds. Of course, as mentioned previously, by varying the number and sizes of the coin receptacles 74 provided in the magazine 70 various coin mixes can be included in the magazine. The embodiment illustrated in FIG. 5 includes two receptacles for holding dollar coins, three receptacles for holding quarters, three receptacles for holding dimes, one receptacle for holding nickels, and four receptacles for holding pennies. If the floor plate 79 was designed such that one of the dime receptacles contained a recess that was deep enough to provide for the simultaneous dispensing of two dimes, and both of the dollar coin receptacles contained a recess that was deep enough to provide for the simultaneous dispensing of two dollar coins, then the arrangement shown in FIG. 5 could dispense $4.99 in a single revolution. Although it is not necessary for the coin dispenser to dispense the desired mix of coins in a single revolution, such a feature reduces the total dispense time.

An advantage of the disclosed arrangement, compared to the arrangement disclosed in U.S. Pat. No. 3,191,609, is that the magazine does not need to stop in order to complete a dispense cycle. That is, unlike the device of the above-mentioned patent, a rotating coin-receiving cup does not need to come into alignment with an outlet of the coin housing before a user can access the dispensed coins. In fact, it is not necessary for the present magazine to stop rotating between dispense cycles. Rather, the magazine could continuously rotate, even when coins were not being dispensed. This would slightly decrease the total amount of time required to complete a dispense cycle because no time would be required to get the magazine rotating at its dispensing speed (i.e., from a stopped position). The present arrangement also does not require any ramps, etc. to guide dispensed coins to the coin-receiving cup.

There are numerous ways in which a controller of the coin dispenser can control actuation of the coin-ejection mechanism in order to eject the desired coins. The controller needs to know the particular mix of coins in the magazine that is loaded into the coin dispenser, and then be able to keep track of which receptacle of the loaded magazine is presently at the dispense location (i.e., the location adjacent to outlet 25 where the pin 110 is appropriately aligned with the receptacle.

The magazine 70 can include indicia, for example, a bar code, that indicates the mix of coins contained therein. The indicia would be read by, for example, an optical reader contained within the coin dispenser so that the controller, for example, a programmed CPU or, more preferably, a hard-wired circuit (ASIC) would know the type of magazine contained therein. Alternatively, the user could simply indicate the type of magazine by selecting a button or switch, or the machine may be a dedicated machine that uses only one type of magazine.

Once the controller knows the type of magazine that is loaded in the coin dispenser, it can consult a memory (e.g., a PROM) to determine the order of the receptacles. In order to keep track of which receptacle is located at the dispense position, the magazine could include a course encoder, i.e., a series of white and black marks corresponding to the receptacles, that are conveyed past a stationary optical reader mounted to the base 30. The course encoder would include a home position mark located at a known position (e.g., between the two dollar coin receptacles in the FIG. 5 arrangement). After sensing the home position mark, the controller would know the positional relationship between the magazine and the pin so that the pin could be actuated when desired. Alternatively, indicia, such as bar codes, for example, can be included in alignment with each of the coin receptacles 74 which indicate the specific type of coin contained in that receptacle. These bar codes would be read by a second bar code reader contained within the coin dispenser, and which reads the bar codes as the magazine is rotated. This information would be used by the coin dispenser controller in order to know when to actuate the solenoid 52 in order to dispense a particular type of coin.

Preferably, a low-coin detector, such as, e.g., a photo-detector or a proximity sensor, is mounted to the stationary base to detect whether the supply of coins in any of the receptacles is low. FIG. 1 schematically represents a proximity sensor 180 mounted to the stationary base 30, radially inward of the inner diameter of the magazine 70. The proximity sensor 180 senses whether any coins are present in the lower portion of the receptacles 74 as the magazine rotates. Preferably the sensor is located at an appropriate height such that it will no longer sense coins in a receptacle when there are a small number (e.g., 3–6) of coins remaining in the receptacle. The machine can then avoid selecting receptacles having a low supply (for example, if one quarter receptacle is low, a different quarter receptacle is selected, or two dime receptacles and one nickel receptacle are selected). The machine also preferably provides an audible or visual alarm indicating that the magazine should be replaced. If the coin detector is a photo-detector, it would include, for example, a light emitter located internally of the magazine and that emits a light beam radially outward through the magazine, and a light receiver mounted radially outward of the magazine. If the coin receptacles contain a suitable number of coins, those coins block the light beam. However, when the number of coins in a receptacle becomes low, the light receiver will receive the light beam, and the coin dispenser controller will determine that the number of coins in that receptacle is low. It is preferable that the apparatus make this determination before the last coin is dispensed from a receptacle so that the apparatus does dispense an incorrect amount. Since the magazine moves the receptacles past the low-coin detector, it is only necessary to provide a single sensor. However, as an additional feature, it is also possible to provide a second detector located approximately half-way up the height of the magazine in order to provide a signal indicating that a receptacle is about half-empty. If the magazine is made from an opaque material, it can include slots in the receptacles so that the detector(s) can sense the coins. However, if the magazine is made from a transparent plastic material, for example, it is not necessary to include slots in the receptacles.

Another advantage of the disclosed architecture, in which a rotatable magazine conveys coin receptacles past a stationary actuator, is that only a single actuator is required in order to eject coins from all of the receptacles. This greatly reduces the cost and complexity of the coin dispenser compared to the linear type of coin dispenser that is prevalent in the market place, and which requires a separate (dedicated) actuator for each coin receptacle.

Another advantage of the disclosed architecture is that it is easily adaptable to different coin mixes (i.e., to different magazines having different numbers and sizes of slots). One coin dispenser could be used with different magazines, including magazines with coins from different countries, simply by programming the machine with data indicating the different types of coin mixes (including data on the coin denomination and the number of coins dispensed with one actuation of the ejector mechanism 50—usually one or two coins at a time) contained in the different magazines. This is not easily obtained with coin dispenser having a line of coin tubes and a coin-ejection solenoid for each tube, because the number of tubes and the spacing between each tube is fixed. In the present architecture, the same coin dispenser can be used with different magazines having different numbers of receptacles therein, and a different spacing between each receptacle.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A coin dispenser comprising:

a stationary base;

a rotatable magazine that rotates about a rotation axis relative to the stationary base, and includes a plurality of coin receptacles extending substantially parallel to the rotation axis, each coin receptacle for holding a stack of coins; and a stationary actuator that is non-rotatably mounted to the stationary base, and is operatively associated with the rotatable magazine and that includes a coin-ejection member that moves linearly in a direction substantially parallel to the rotation axis of the rotatable magazine between an extended position and a retracted position, the extended position being a position in which the coin-ejection member contacts at least a lowermost coin in a specified one of the coin receptacles.

2. The coin dispenser of claim 1, wherein a lowermost portion of each coin receptacle includes a coin-ejection slot through which at least a lowermost coin in the receptacle is ejected from the rotatable magazine as the receptacle is conveyed past the coin-ejection member in the extended position during rotation of the rotatable magazine.

3. The coin dispenser of claim 2, wherein each of the coin-ejection slots includes a longitudinal axis that extends at a non-zero angle relative to a radial direction of the rotatable magazine.

4. The coin dispenser of claim 2, wherein each of the coin-ejection slots has an outlet on a radially outer surface of the rotatable magazine.

5. The coin dispenser of claim 1, further comprising a drive motor mounted to the stationary base and including a drive gear; wherein:

the rotatable magazine is removably mounted to the stationary base such that the drive gear couples to and rotates the rotatable magazine about the rotation axis, and the stationary actuator is mounted to the stationary base.

6. The coin dispenser of claim 5, wherein the stationary actuator includes a single electro-mechanical actuator, and the drive motor and the single electro-mechanical actuator are the only electro-mechanical drive mechanisms included in the coin dispenser.

7. The coin dispenser of claim 1, wherein the stationary actuator includes a torsion-resistant mount that permits the coin-ejection member to deflect if a coin that is to be ejected from the rotatable magazine becomes jammed in the rotatable magazine.

8. The coin dispenser of claim 1, further comprising a low-coin detector that detects whether the stack of coins in any of the receptacles is below a predetermined level.

9. A coin dispenser comprising:

a stationary base;

a magazine that is removably mounted to the stationary base and that rotates about a rotation axis relative to the stationary base, the magazine including a plurality of coin receptacles extending substantially parallel to the rotation axis, each coin receptacle for holding a stack of coins;

a drive motor mounted to the stationary base, and operatively coupled to the magazine when the magazine is mounted to the stationary base in order to rotate the magazine; and an actuator non-rotatably mounted to the stationary base and including a coin-ejection pin that moves linearly in a direction substantially parallel to the rotation axis of the magazine between an extended position and a retracted position, the extended position being a position in which the coin-ejection pin contacts at least a lowermost coin in the coin receptacles as the coin receptacles travel past the coin-ejection pin during rotation of the magazine by the drive motor.

10. The coin dispenser of claim 9, wherein a lowermost portion of each coin receptacle includes a coin-ejection slot through which at least a lowermost coin in the receptacle is ejected from the magazine as the receptacle travels past the coin-ejection pin in the extended position during rotation of the magazine by the drive motor.

11. The coin dispenser of claim 10, wherein each of the coin-ejection slots includes a longitudinal axis that extends at a non-zero angle relative to a radial direction of the magazine.

12. The coin dispenser of claim 10, wherein each of the coin-ejection slots has an outlet on a radially outer surface of the magazine.

13. The coin dispenser of claim 9, wherein the actuator includes a single electro-mechanical actuator, and the drive motor and the single electro-mechanical actuator are the only electro-mechanical drive mechanisms included in the coin dispenser.

14. The coin dispenser of claim 9, wherein the actuator includes a torsion-resistant mount that permits the coin-ejection pin to deflect if a coin that is to be ejected from the magazine becomes jammed in the magazine.

15. The coin dispenser of claim 9, further comprising a low-coin detector that detects whether the stack of coins in any of the receptacles is below a predetermined level.

16. A coin dispenser comprising:

a stationary base;

a magazine that is removably mounted to the stationary base and that rotates about a rotation axis relative to the stationary base, the magazine including a plurality of coin receptacles extending substantially parallel to the rotation axis, each coin receptacle for holding a stack of coins, an ejection outlet of each of the coin receptacles being located in a lowermost portion of each of the coin receptacles such that the ejection outlets are located in a plane that is orthogonal to the rotation axis;

a drive motor mounted to the stationary base, and operatively coupled to the magazine when the magazine is mounted to the stationary base in order to rotate the magazine; and an actuator non-rotatably mounted to the stationary base and including a coin-ejection member that moves linearly in a direction substantially parallel to the rotation axis of the magazine between an extended position and a retracted position, the extended position being a position in which the coin-ejection member extends into the plane containing the coin receptacle outlets in order to contact and eject at least a lowermost coin in the coin receptacles as the coin receptacles travel past the coin-ejection member during rotation of the magazine by the drive motor, the retracted position being a position where the coin-ejection member does not extend into the plane containing the coin outlets.

17. The coin dispenser of claim 16, wherein the coin outlet of each of the coin receptacles is part of a coin-ejection slot through which at least a lowermost coin in the receptacle is ejected from the magazine as the receptacle travels past the coin-ejection member in the extended position during rotation of the magazine by the drive motor.

18. The coin dispenser of claim 16, wherein each of the coin-ejection slots includes a longitudinal axis that extends at a non-zero angle relative to a radial direction of the magazine.

19. The coin dispenser of claim 17, wherein each of the coin outlets is located on a radially outer surface of the magazine.

20. The coin dispenser of claim 16, wherein the actuator includes a single electro-mechanical actuator, and the drive motor and the single electro-mechanical actuator are the only electro-mechanical drive mechanisms included in the coin dispenser.

21. The coin dispenser of claim 16, wherein the actuator includes a torsion-resistant mount that permits the coin-ejection member to deflect if a coin that is to be ejected from the magazine becomes jammed in the magazine.

22. The coin dispenser of claim 16, further comprising a low-coin detector that detects whether the stack of coins in any of the receptacles is below a predetermined level.

* * * * *